United States Patent [19]

Houck, Jr. et al.

[11] Patent Number: 4,649,944

[45] Date of Patent: Mar. 17, 1987

[54] FILTER CIGARETTE

[75] Inventors: Willie G. Houck, Jr.; Walter A. Nichols; Reginald W. Newsome, all of Richmond, Va.

[73] Assignee: Philip Morris Incorporated, New York, N.Y.

[21] Appl. No.: 640,589

[22] Filed: Aug. 14, 1984

Related U.S. Application Data

[63] Continuation-in-part of Ser. No. 429,394, Sep. 30, 1982, abandoned.

[51] Int. Cl.[4] ..... A24D 3/04

[52] U.S. Cl. ..... 131/336; 131/337; 131/198.2

[58] Field of Search ..... 131/336, 338, 339, 340, 131/190 R, 198 A, 337, 198.1, 198.2

[56] References Cited

U.S. PATENT DOCUMENTS

| | | |
|---|---|---|
| 1,015,723 | 1/1912 | Blackwood . |
| 2,269,995 | 1/1942 | Trane . |
| 2,693,193 | 11/1954 | Pelletier . |
| 2,841,153 | 7/1958 | Pelletier . |
| 2,923,647 | 2/1960 | Aghnides . |
| 2,936,763 | 5/1960 | Saffir . |
| 3,057,360 | 10/1962 | Bugge . |
| 3,116,741 | 1/1964 | Speck . |
| 3,232,299 | 2/1966 | Miller . |
| 3,283,762 | 11/1966 | Kissel . |
| 3,327,718 | 6/1967 | Kilburn . |
| 3,359,988 | 12/1967 | Thomson . |
| 3,376,874 | 4/1968 | Kim et al. . |
| 3,428,050 | 2/1969 | Kandel . |
| 3,441,028 | 4/1969 | Wall . |
| 3,463,166 | 8/1969 | Bennett et al. . |
| 3,486,508 | 12/1969 | Sipos . |
| 3,496,945 | 2/1970 | Tomkin . |
| 3,503,406 | 3/1970 | Riegel et al. . |
| 3,504,678 | 4/1970 | Pitt . |
| 3,512,537 | 5/1970 | Pelletier . |
| 3,515,146 | 6/1970 | Nealis . |
| 3,519,000 | 7/1970 | Houser . |
| 3,596,665 | 8/1971 | Lindgard . |
| 3,601,131 | 8/1971 | Reggio . |
| 3,608,561 | 9/1971 | Dock ..... 131/361 |
| 3,664,350 | 5/1972 | Wall . |
| 3,685,522 | 8/1972 | Kleinhans . |
| 3,695,274 | 10/1972 | Summers . |
| 3,713,452 | 1/1973 | D'Elia et al. . |
| 3,738,375 | 6/1973 | Doumas . |

List Continued on next page.

FOREIGN PATENT DOCUMENTS

| | | |
|---|---|---|
| 901910 | 6/1972 | Canada . |
| 913486 | 10/1972 | Canada . |
| 874119 | 3/1953 | Fed. Rep. of Germany . |
| 1782545 | 9/1971 | Fed. Rep. of Germany . |
| 1034663 | 4/1953 | France . |
| 2422345 | 11/1979 | France . |
| 706624 | 3/1954 | United Kingdom . |
| 1058343 | 2/1967 | United Kingdom . |
| 1095848 | 12/1967 | United Kingdom . |
| 1446472 | 8/1976 | United Kingdom . |
| 2099678 | 12/1982 | United Kingdom . |

*Primary Examiner*—V. Millin

*Attorney, Agent, or Firm*—Jeffrey H. Ingerman

[57] ABSTRACT

A filter cigarette is provided which is adjustable to provide a wide range of air dilution and/or RTD values and which comprises a tobacco rod, a wrapped, substantially cylindrical filter plug, and tipping paper. The filter plug comprises a first, mouth-end segment and a second, axially aligned, rod-end segment spaced apart from the first segment. The wrapping circumscribes the first and second segments defining a substantially cylindrical void therebetween which may include means of releasing varying amounts of a flavorant. The first segment is movable towards the second segment thereby compressing the plug wrap between the segments which decreases the volume of the void and increases the RTD value of the cigarette. Variable air dilution is achieved by providing at least one opening in the tipping paper and at least one opening in the underlying plug wrap positioned such that, as the first segment is moved axially towards the second segment, the first and second openings are moved into varying degrees of registry, thereby admitting varying amount of air to the filter.

21 Claims, 11 Drawing Figures

U.S. PATENT DOCUMENTS

| | | | |
|---|---|---|---|
| 3,759,268 | 9/1973 | Piourde . | |
| 3,773,053 | 11/1973 | Stephens, Jr. . | |
| 3,774,622 | 11/1973 | Steigerwald . | |
| 3,789,855 | 2/1974 | Norman | 131/336 |
| 3,847,161 | 11/1974 | Morgenstern . | |
| 3,916,914 | 11/1975 | Brooks et al. . | |
| 4,201,234 | 5/1980 | Neukomm . | |
| 4,219,030 | 8/1980 | Hall . | |
| 4,232,574 | 11/1980 | Hall . | |
| 4,254,782 | 3/1981 | Ligeti . | |
| 4,340,074 | 7/1982 | Tudor | 131/336 |
| 4,343,319 | 8/1982 | Cantrell . | |
| 4,362,171 | 12/1982 | Johnson et al. . | |
| 4,369,796 | 1/1983 | Hall . | |
| 4,380,241 | 4/1983 | Horsewell . | |
| 4,433,696 | 2/1984 | Adams | 131/336 |

FILTER CIGARETTE

CROSS-REFERENCE TO RELATED APPLICATION

This application is a continuation-in-part of copending U.S. patent application Ser. No. 429,394, filed Sept. 30, 1982 now abandoned.

BACKGROUND OF THE INVENTION

The present invention relates to filter cigarettes. More particularly, the present invention relates to filter cigarettes which are adjustable to provide wide range of air dilution and/or resistance-to-draw (hereinafter "RTD") values.

Various mechanisms have been disclosed in heretofore issued patents which provide for adjustment of the air dilution value of a filter cigarette, but these mechanisms are not without certain disadvantages. While many complicated mechanisms have been disclosed, the simpler mechanisms generally involve making one or more openings through a substantially air-impermeable filter plug wrap and the overlying, substantially air-impermeable tipping paper and one or more corresponding openings in a sleeve which is placed over the tipping paper and which is then either rotated or moved axially to select the degree to which the two sets of openings are in registry. In another embodiment found in the art, the filter is not glued to the tipping paper and thus may be moved axially within the cylinder formed by the tipping paper. Openings are made in the filter plug wrap and corresponding openings are made in the tipping paper. The air dilution value is adjusted by axially moving the filter plug within the tipping paper to adjust the degree to which the two sets of openings are in registry.

Among the problems associated with such mechanisms are that the sleeve or filter plug may be removed from the cigarette by the smoker and not readily replaced, and that when dilution is desired, thus requiring some degree of registry between the two sets of openings, this registry may be inadvertently destroyed by a slight axial movement of the sleeve or plug. Accordingly, the dilution, once set by the smoker, is not insured of any degree of consistency. Yet another problem associated with a number of these prior devices is that they have not been readily adaptable to a high rate of production on cigarette making machinery of conventional design.

Accordingly, it is an object of the present invention to provide a cigarette which can be readily manufactured on conventional cigarette making equipment and that is adjustable to vary the ratio of air to smoke delivered to the mouth of the smoker.

SUMMARY OF THE INVENTION

A cigarette is provided which comprises a tobacco rod, that is, a charge of tobacco wrapped in cigarette paper, a wrapped, substantially cylindrical filter plug, and tipping paper. The cigarette is adjustable to provide a wide range of air dilution and/or RTD values and may include means for releasing varying amounts of flavorant. The range of air dilution values has a minimum dilution value which can be set during manufacture of the cigarette. The smoker can adjust the dilution above the preset minimum value. (The air dilution value is the ratio of the volume of air to the volume of smoke exiting the mouth end of the filter, expressed as a percentage.)

The tobacco rod and the filter plug are axially aligned in abutting end-to-end relation and are circumscribed by the tipping paper. The filter plug has a mouth end and a rod end which are open to permit the passage of air and smoke and comprises a first mouth-end segment and a second, axially aligned rod-end segment spaced apart from the first segment. The wrapping circumscribes the first and second segments, thereby defining a substantially cylindrical void between the first and second segments. The second segment is attached to the tobacco rod. The first segment is movable towards the second segment thereby compressing the plug wrap defining the cylindrical void, which decreases the volume of the void and increases the RTD value of the cigarette. There is at least one opening in the tipping paper and at least one opening in the underlying plug wrap positioned such that as the first segment is moved axially towards the second segment, the first and second openings are moved into varying degrees of registry, thereby admitting varying amounts of air to the filter, changing the air dilution value of the cigarette.

The wrapping can be substantially air-impermeable, in which case the minimum air dilution value is close to zero, or it can be air-permeable, in which case the minimum air dilution value is a finite value which is determined by the permeability of the wrapping.

DESCRIPTION OF THE PREFERRED EMBODIMENTS

Figure 1:
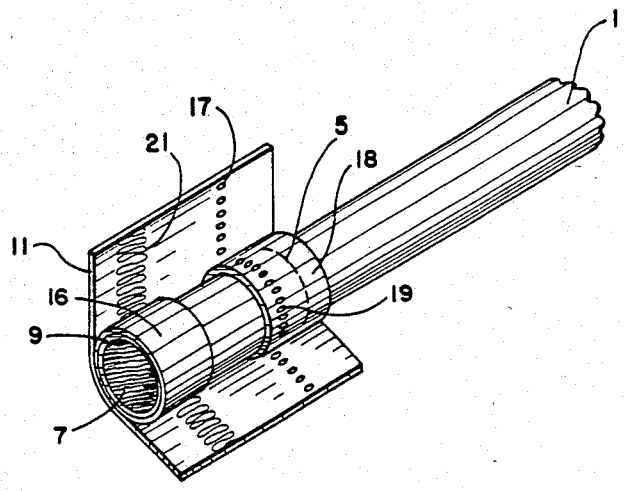
FIG. 1 is an enlarged, partially fragmentary perspective view, taken from the mouth end, of a first preferred embodiment of the filter cigarette of the present invention.

The present invention will now be described with reference to FIGS. 1 through 11 in which like parts are given like reference numbers throughout.

Common to the preferred embodiments of the present invention are the following elements. A tobacco rod 1 comprising a substantially cylindrical charge of tobacco 13 is enclosed in cigarette paper 15 and is axially aligned with a filter plug comprising a first filter segment 7 and a second filter segment 3. Means are provided joining the tobacco rod 1 to the second segment 3 in abutting end-to-end relation at the line of abutment 5. The first and second segments are spaced apart and are joined by a circumscribing wrapping 9. This wrapping initially defines a substantially cylindrical void between the first and second segments. The tipping paper 11 circumscribes the filter plug and the mouth end of the tobacco rod. The tipping paper extends from a position intermediate the ends of the first segment to a position on the tobacco rod 1 adjacent the rod end of the second segment 3. Either the plug wrap 9, the tipping paper 11, or both, are substantially air-impermeable.

A first opening is provided in the tipping paper and a second opening is provided in the underlying plug wrap. The first segment 7 is movable along the longitudinal axis of the cigarette towards the second segment 3 either by rotation or by translation. Movement along this axis compresses the plug wrap between the segments thereby decreasing the volume of the void 8 which varies the RTD value of the cigarette. The first and second openings are positioned such that movement of the first segment moves the openings into varying degrees of registry, thereby admitting varying amounts of air to the filter, thereby varying the air dilution value of the cigarette. The cigarette can be designed such that the increasing dilution correlates with increasing RTD to provide a constant RTD value.

Figure 11:
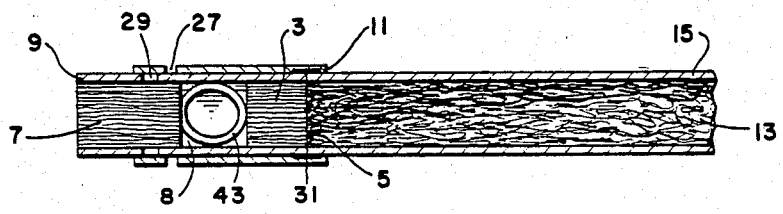
FIG. 11 is a view similar to FIG. 9 but showing a flavor generator positioned in the void between the first and second segments.

The cigarette of the present invention, as shown in FIG. 11, may optionally include a flavor generator 43 in the void 8 which is designed to release increasing amounts of a flavorant within the void responsive to movement of the first segment 7 towards the second segment 3. As a flavor generator, an encapsulation system may be employed, such as strips of cellophane containing discrete reservoirs of one or more flavorants which are designed to burst responsive to the pressure exerted by movement of the first segment towards the second segment. Other equivalent flavor generators which will occur to those skilled in the art may also be employed.

If desired, the first and second openings may be omitted resulting in a filter cigarette which has a variable RTD. This variable RTD embodiment may optionally include a flavor generator.

Figure 2:
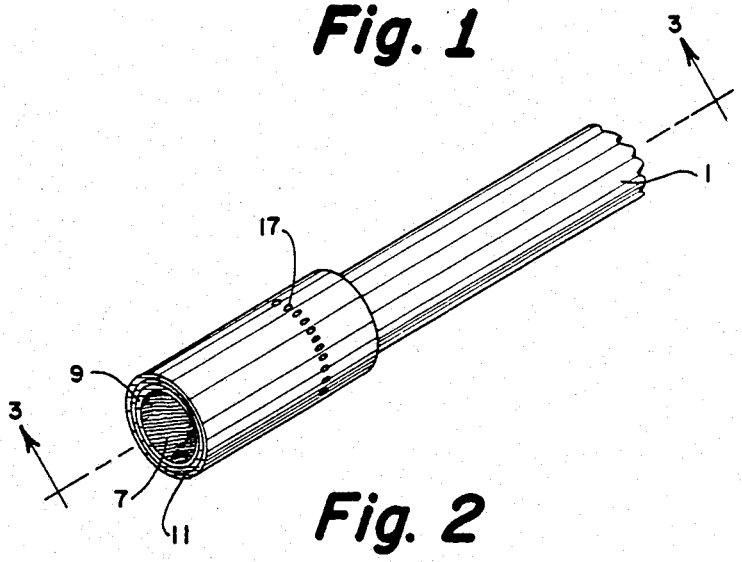
FIG. 2 is an enlarged perspective view, taken from the mouth end, of the assembled embodiment of FIG. 1.
Figure 3:
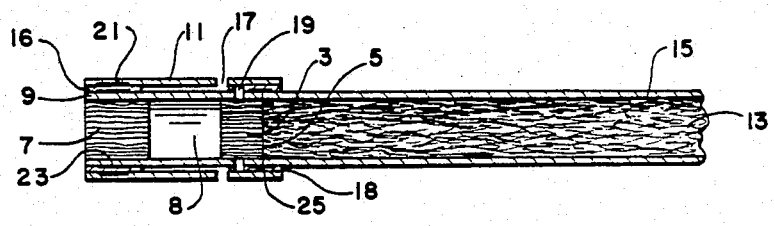
FIG. 3 is a cross-sectional view taken along the line 3—3 of FIG. 2.

In a first preferred embodiment shown in FIGS. 1 through 3, bands 16 and 18 are interposed between the tipping paper and the plug wrap. Band 16 extends from the mouth end of the first segment 7 up to the rod end of the first segment and is attached to the underlying plug wrap 9. Band 18 extends from a position on the tobacco rod 1 adjacent the rod end of segment 3 up to the mouth end of segment 3. Band 18 is attached to cigarette paper 15 and plug wrap 9 and joins segment 3 to the tobacco rod 1. The tipping paper 11 extends from the mouth end of segment 7 to a position on the tobacco rod 1 which corresponds to the position of the rod end of band 18. At least one opening 17 is provided in the tipping paper and at least one opening 19 is provided through the band 18 and the underlying plug wrap 9. The tipping paper 11 is attached only to band 16 for movement therewith along the axis of the cigarette towards the coal end of tobacco rod 1.

In practice, the smoker moves the tipping paper 11 axially towards the coal end of the tobacco rod 1 which moves segment 7 towards segment 3 compressing the plug wrap between the first and second segments thereby increasing the RTD value and varying the degree of registry between the openings 17 and 19 to vary the air dilution value of the cigarette.

The openings 17 and 19 may be made simultaneously through the assembled cigarette to provide an embodiment having, initially, a maximum air dilution value which is decreased by movement of the first segment 7 towards the second segment 3, or the openings 17 and 19 may be made such that they are initially not in any degree of registry such that the cigarette has, initially, a minimum air dilution value which is increased by movement of the first segment 7 towards the second segment 3.

The band 18 joins the tobacco rod 1 to the segment 3, preferably by means of band of adhesive 25 which overlaps the line of abutment 5. The tipping paper is preferably attached to the underlying band 16 by an adhesive material 21 and the band 16 is preferably attached to the underlying plug wrap 9 by means of an adhesive material 23.

This embodiment, as well as those embodiments discussed below, may be fabricated using existing cigarette making equipment, which is commercially available and known to those skilled in the art, with only minor modifications. The openings in the tipping paper and the underlying layers may be made employing any conventional means such as electrostatic discharge apparatus, mechanical perforation apparatus, or a laser perforation system. The openings may be made either before or after assembly.

Figure 4:
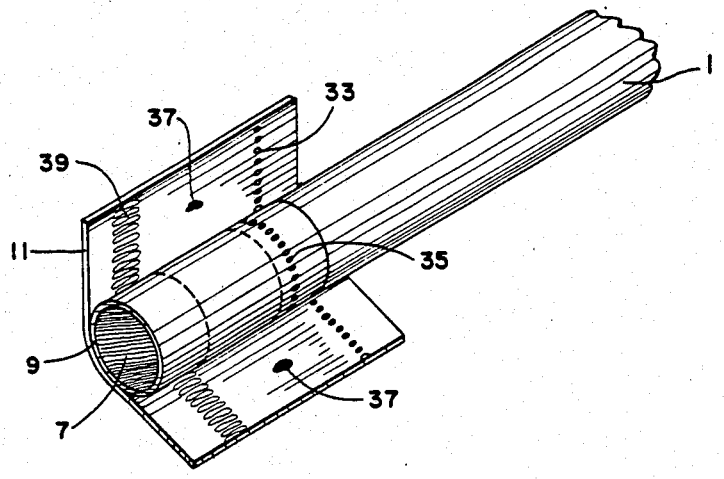
FIG. 4 is an enlarged, partially fragmentary perspective view, taken from the mouth end, of a second preferred embodiment of the filter cigarette of the present invention.
Figure 5:
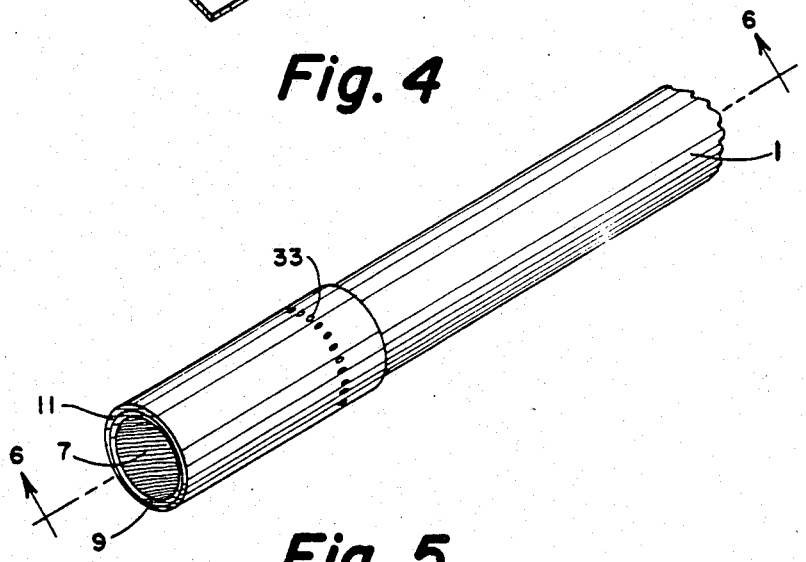
FIG. 5 is an enlarged perspective view, taken from the mouth end, of the assembled embodiment of FIG. 4.
Figure 6:
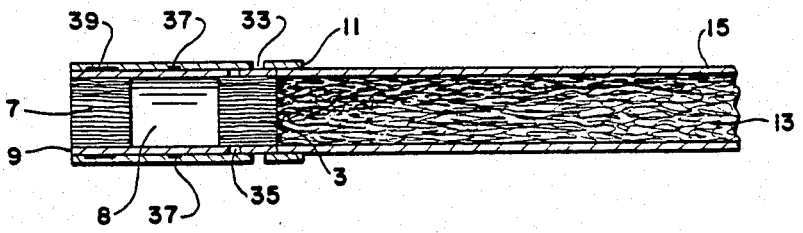
FIG. 6 is a cross-sectional view taken along the line 6—6 of FIG. 5.
Figure 7:
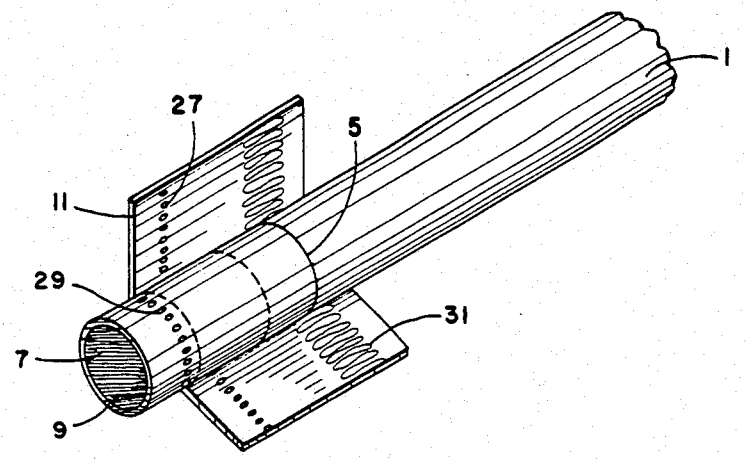
FIG. 7 is an enlarged, partially fragmentary perspective view, taken from the mouth end, of a third preferred embodiment of the filter cigarette of the present invention.
Figure 8:
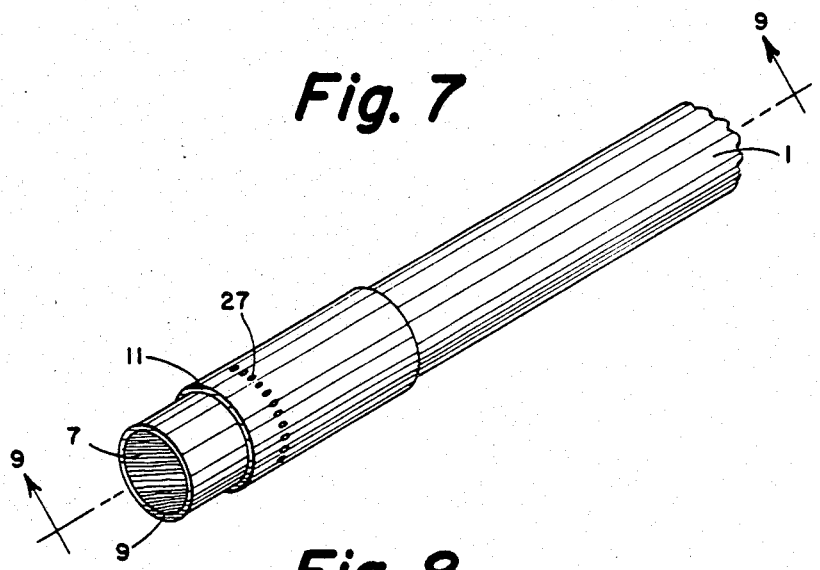
FIG. 8 is an enlarged perspective view, taken from the mouth end, of the assembled embodiment of FIG. 7.
Figure 9:
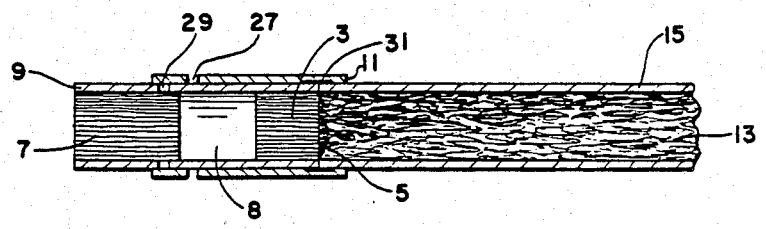
FIG. 9 is a cross-sectional view taken along the line 9—9 of FIG. 8.

In a second preferred embodiment shown in FIGS. 4 through 6, the tipping paper 11 extends as in the first embodiment but is attached directly to the plug wrap 9 over the first segment 7, preferably by means of a band of adhesive material 39. Discrete areas of adhesive material 37 are applied to the inner surface of the tipping paper 11 at positions about the circumference of the inner surface of the tipping paper which overlie the plug wrap intermediate the rod end of segment 7 and the mouth end of segment 3 and define a plane which is perpendicular to the longitudinal axis of the cigarette. A first opening 33 is provided in the tipping paper 11 and a second opening 35 is provided in the plug wrap overlying the segment 3. The openings 33 and 35 are positioned and function to vary the air dilution value as described in connection with the first embodiment.

With one exception, this second embodiment operates as described for the first embodiment and may be modified in the same way as the first embodiment. The exception being that the discrete areas of adhesive material 37 join the tipping paper to the plug wrap 9 such that the rod end of the tipping paper moves towards the mouth end of the cigarette responsive to movement of the first segment 7 towards the second segment 3. In the first embodiment, the entire length of tipping paper 11 moves in the direction of movement of the first segment 7. This movement of the rod end of the tipping paper 11 is caused by compression of the plug wrap 9 overlying the void 8, which compression draws the tipping paper towards the longitudinal axis.

In a third preferred embodiment shown in FIGS. 7 through 10, the tipping paper 11 extends from a position intermediate the mouth end and rod end of segment 7 to a position on tobacco rod 1 adjacent the rod end of segment 3. The tipping paper is attached only to the plug wrap overlying segment 3 and to the cigarette paper adjacent the rod end of segment 3, thereby attaching the tobacco rod 1 to the second segment 3. Preferably, the means of attachment is a band of adhesive 31 which overlaps the line of abutment 5. A first opening 27 is provided in the tipping paper 11 and a second opening 29 is provided in the plug wrap overlying the first segment 7 at a position intermediate the mouth end of tipping paper 11 and the rod end of segment 7.

Figure 10:
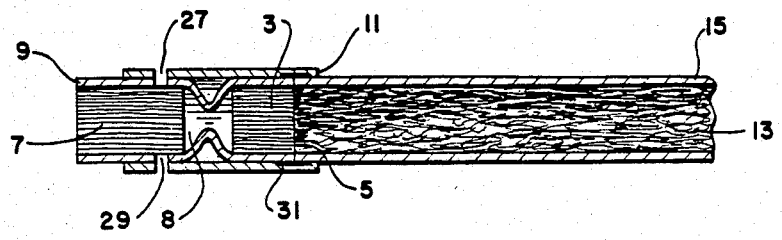
FIG. 10 is a view similar to FIG. 9 and showing the first segment moved to a position towards the second segment at which the openings in the tipping paper are in registry with the openings in the plug wrap.

In practice, the first segment 7 is moved axially towards the second segment 3 either by a longitudinally acting force which may be applied by holding the cigarette rod and tapping the protruding end of the first segment 7, or by grasping the protruding end and rotating it. This movement compresses the plug wrap 9 which overlies the void 8 as shown in FIG. 10, thereby decreasing the volume of the void 8 and varying the RTD value of the cigarette. This movement also varies the degree of registry of the openings 27 and 29 thereby varying the air dilution value of the cigarette. These openings may be formed and positioned in any of the ways discussed in connection with the first embodiment. The various modifications discussed in connection with the first embodiment are also applicable to the third embodiment.

In all of the embodiments described above, as well as in any other embodiment within the scope of the present invention, plug wrap 9 and the tipping paper 11 can be either air-permeable or substantially air-impermeable; however, at least one of the two layers must be substantially air-impermeable. Regardless of the degree of permeability of the plug wrap 9 or tipping paper 11, the maximum air dilution value when the openings in the plug wrap 9 and the tipping paper 11 are in full registry will be approximately the same; however, the minimum air dilution value will vary. When both plug wrap 9 and tipping paper 11 are substantially air-impermeable, the minimum air dilution value, which is obtained when the openings are fully deregistered, will be close to zero. Any deviation from a zero dilution value will be the result of leakage—e.g., from the opening in the tipping paper 11, along the space between the plug wrap 9 and the tipping paper 11, to the opening in the plug wrap 9.

When tipping paper 11 is substantially air-impermeable and plug wrap 9 is air-permeable, some dilution air will enter through the opening in tipping paper 11 and pass through permeable plug wrap 9 even when the openings are fully deregistered. Similarly, when tipping paper 11 is air-permeable and plug wrap 9 is substantially air-impermeable, some dilution air will pass through permeable tipping paper 11 and enter the opening in plug wrap 9 even when the openings are fully deregistered. The amount of dilution air that enters the filter in either of these cases can be predetermined by properly selecting the porosity of the permeable layer. Methods of selecting porosity of cigarette papers are well known to those in the art. The only limitation on the selection is that the permeable layer cannot be so permeable that the manipulation of the openings will not produce a noticeable change in the air dilution value. For this reason, one cannot make both layers air-permeable, otherwise too much air will enter the filter even when the openings are fully deregistered, so that bringing them into registry will cause no noticeable difference in dilution.

It will be understood that the particular embodiments described are only illustrative of the principles of the present invention, and that various modifications can be made by those skilled in the art without departing from the scope and spirit of the present invention.

We claim:

1. A filter cigarette comprising a tobacco rod, a substantially cylindrical filter plug assembly having a first mouth-end filter plug segment and a second, axially aligned rod-end filter plug segment spaced apart from the first segment, means joining the tobacco rod to the second segment in axially aligned, abutting end-to-end relation, plug wrapping fixed to the first segment and to the second segment and defining a substantially cylindrical void therebetween, said plug wrapping being compressible in the region of said void, and tipping paper circumscribing the filter plug and the mouth end of the tobacco rod, either or both of said plug wrapping and said tipping paper being substantially air-impermeable, said first segment being movable along the longitudinal axis of the cigarette towards the second segment, whereby the plug wrapping in the region of said void between the first segment and the second segment is compressed, thereby decreasing the volume of said void and varying the resistance-to-draw of the cigarette.

2. The cigarette of claim 1 including a first contiguous band extending from the mouth end of the filter plug assembly to a position on the first segment adjacent the void and attached to the first segment for movement therewith, said means joining the second segment to the tobacco rod comprising a second contiguous band extending from a position on the tobacco rod adjacent the second segment to a position on the second segment adjacent the void, said tipping paper overlying said first and second bands and extending from the mouth end of the filter plug assembly to the tobacco rod end of the second band, said tipping paper being attached to the first band for movement therewith.

3. The cigarette of claim 2 including a first opening in the tipping paper and a second opening in the plug wrap positioned such that the first and second openings are movable into varying degrees of registry responsive to movement of the first segment towards the second segment, whereby the air dilution of the cigarette is varied.

4. The cigarette of claim 2 including a flavor generating disposed in the void and adapted to release varying amounts of a flavorant responsive to movement of the first segment towards the second segment.

5. The cigarette of claim 1 wherein the tipping paper extends from the mouth end of the first segment to a position on the tobacco rod adjacent the second segment, said tipping paper being attached to the first segment and including points of attachment to the plug wrapping spaced about the circumference of the inner surface of the tipping paper, said points of attachment being disposed in a plane perpendicular to the longitudinal axis of the cigarette, and intermediate the rod end of the first segment and the mouth end of the second segment.

6. The cigarette of claim 5 including a first opening in the tipping paper and a second opening in the plug wrap positioned such that the first and second openings are movable into varying degrees of registry responsive to movement of the first segment towards the second segment, whereby the air dilution of the cigarette is varied.

7. The cigarette of claim 5 including a flavor generator disposed in the void and adapted to release varying amounts of a flavorant responsive to movement of the first segment towards the second segment.

8. The cigarette of claim 1 wherein the tipping paper extends from a position intermediate the mouth end and the rod end of the first segment to a position on the tobacco rod adjacent the second segment, said tipping paper being attached to and joining the second segment and the tobacco rod.

9. The cigarette of claim 8 including a first opening in the tipping paper and a second opening in the plug wrap positioned such that the first and second openings are movable into varying degrees of registry responsive to movement of the first segment towards the second segment, whereby the air dilution of the cigarette is varied.

10. The cigarette of claim 8 including a flavor generator disposed in the void and adapted to release varying amounts of a flavorant responsive to movement of the first segment towards the second segment.

11. The cigarette of claim 1 wherein said plug wrapping and said tipping paper are substantially air-impermeable.

12. The cigarette of claim 11 including a first opening in the tipping paper and a second opening in the plug wrap positioned such that the first and second openings are movable into varying degrees of registry responsive to movement of the first segment towards the second segment, whereby the air dilution of the cigarette is varied.

13. The cigarette of claim 11 including a flavor generator disposed in the void and adapted to release varying amounts of a flavorant responsive to movement of the first segment towards the second segment.

14. The cigarette of claim 1 wherein said plug wrapping is substantially air-impermeable and said tipping paper is air-permeable.

15. The cigarette of claim 14 including a first opening in the tipping paper and a second opening in the plug wrap positioned such that the first and second openings are movable into varying degrees of registry responsive to movement of the first segment towards the second segment, whereby the air dilution of the cigarette is varied.

16. The cigarette of claim 14 including a flavor generator disposed in the void and adapted to release varying amounts of a flavorant responsive to movement of the first segment towards the second segment.

17. The cigarette of claim 1 wherein said plug wrapping is air-permeable and said tipping paper is substantially air-impermeable.

18. The cigarette of claim 17 including a first opening in the tipping paper and a second opening in the plug wrap positioned such that the first and second openings are movable into varying degrees of registry responsive to movement of the first segment towards the second segment, whereby the air dilution of the cigarette is varied.

19. The cigarette of claim 17 including a flavor generator disposed in the void and adapted to release varying amounts of a flavorant responsive to movement of the first segment towards the second segment.

20. The cigarette of claim 1 including a first opening in the tipping paper and a second opening in the plug wrap positioned such that the first and second openings are movable into varying degrees of registry responsive to movement of the first segment towards the second segment, whereby the air dilution of the cigarette is varied.

21. The cigarette of claim 1 including a flavor generator disposed in the void and adapted to release varying amounts of a flavorant responsive to movement of the first segment towards the second segment.

* * * * *